US006318008B1

(12) United States Patent
Funk et al.

(10) Patent No.: US 6,318,008 B1
(45) Date of Patent: Nov. 20, 2001

(54) PACKET IRONING SYSTEM FOR DOCUMENT FOLDERS

(75) Inventors: Warren S. Funk, Ottsville; Phillip L. Henderson, Doylestown; Christopher K. Cleal, Ivyland, all of PA (US)

(73) Assignee: Printfold Co., Inc., Doylestown, PA (US)

( * ) Notice: Subject to any disclaimer, the term of this patent is extended or adjusted under 35 U.S.C. 154(b) by 0 days.

(21) Appl. No.: 09/694,826

(22) Filed: Oct. 24, 2000

Related U.S. Application Data

(60) Provisional application No. 60/162,215, filed on Oct. 29, 1999.

(51) Int. Cl.[7] ..... D06F 63/00

(52) U.S. Cl. ..... 38/7; 493/947

(58) Field of Search ..... 38/1 R, 7, 8, 9, 38/10, 11, 64; 493/947, 8, 179, 406, 413, 44 L; 100/43, 46, 48, 151, 167, 188, 187

(56) References Cited

U.S. PATENT DOCUMENTS 3,712,610 1/1973 Garrone .
4,164,083 * 8/1979 Glassman ..... 38/11
4,735,367 * 4/1988 Brutosky ..... 100/151 X
4,897,145 1/1990 Marzullo .
5,079,867 * 1/1992 Kober et al. ..... 38/8
5,221,402 6/1993 Westra et al. .
5,265,856 11/1993 Walker .
5,437,596 8/1995 Bogdan et al. .
5,454,304 * 10/1995 Bielfeldt .
5,514,066 5/1996 Monaco .
5,564,684 10/1996 Salancy .
5,807,228 9/1998 Smithe et al. .
5,839,365 11/1998 Calbrix et al. .
5,871,433 2/1999 Lehmann et al. .
6,190,298 * 2/2001 Blumberg .

* cited by examiner

*Primary Examiner*—Ismael Izaguirre
(74) *Attorney, Agent, or Firm*—Gregory J. Gore

(57) ABSTRACT

A packet ironing system for documents fan-folded into a packet which includes a conveyer path bounded laterally by an ironing plate on one side and an opposite-facing backing plate on the other side, defining a conveyance gap therebetween. The leading end of the ironing plate is rotatable about a vertical axis hinge. An actuator for moving the ironing plate about a point of rotation defined by the hinge alters the gap between the ironing plate and the backing plate. Control means which includes a sensor located downstream of infeed rollers signals the actuator to forceably move the ironing plate against the fan-fold document as the document is pulled through the conveyance gap by the infeed rollers.

7 Claims, 2 Drawing Sheets

PACKET IRONING SYSTEM FOR DOCUMENT FOLDERS

The present application relates to U.S. Provisional Patent Application 60/162,215 entitled "Packet Ironing System for Document Folders" filed Oct. 29, 1999 priority from which is hereby claimed.

FIELD OF THE INVENTION

The present invention relates to mechanical folding equipment for paper sheets.

BACKGROUND OF THE INVENTION

Folding machines for large engineering documents ("prints") typically comprise two distinct sections, a fan-folder and a cross-folder. The fan-folder transforms the incoming document into a rectangular packet as shown in FIG. 1, in which the longer dimension (A) is the printer roll width, and the shorter (B) is the desired panel width (typically 8½ inches in the USA, 210 rnm in other countries). The fan-folder in most document folding machines is capable of producing a tightly folded packet with sharp creases shown as (B) in FIG. 2 and few undesirable artifacts. It is in the cross-folder that problems arise if the packet is not positively controlled in the transition from fan-folder to cross-folder. If the panels of the fan-fold packet are allowed to separate, or so-called "billow-out", there is the likelihood that a false, or a double-fold (D) may result as the packet is pulled into the cross-folder through fold rollers under pressure. Another possible consequence is deflection of the entire packet, resulting in cross-folds not orthogonal to the edges of the fan-fold packet. There is, therefore, a need in the art for a device which avoids these problems.

SUMMARY OF THE INVENTION

In order to fill the need in the art which avoids problems described above by including a mechanism in the cross-folder which presses or "irons" the fan-folded document to compact it so that cross folds are made tightly and accurately. The pressing mechanism includes an ironing plate which swings freely about a vertical axis hinge. The plate is forced against the fan folded document by an actuation mechanism which includes a mechanism regulated by a programmed controller. The controller operates a stepper motor which moves the ironing plate in position in stages, a first position which halts the conveyance of the fan-folded document just before the document enters the cross-folder infeed rollers and then a second position which applies a forceful pressure against the document after the document has entered the rollers.

More specifically, the present invention is a packet ironing system for documents fan-folded into a packet, having a path along the conveyer bounded laterally by an ironing plate on one side and an opposite-facing backing plate on the other side, defining a conveyance gap there between. The leading end of the ironing plate is rotatable about a vertical axis hinge. An actuator for moving the ironing plate about a point of rotation defined by the hinge alters the gap between said ironing plate and the backing plate. Infeed rollers move the packet along said conveyor path into a cross folder. Sensor means are located downstream of the infeed rollers for detecting the position of the packet along the conveyor path. The device further includes control means for receiving signals from the sensor and signaling the actuator to forceably move the ironing plate against the fan-fold document as the document is pulled through the gap by the infeed rollers. The device may include a second horizontal hinge between the base of the first vertical hinge pin and a mounting plate so that the ironing plate may also swing in the vertical plane to increase the gap along its top edge.

This device provides the method of compacting a folded paper sheet by delivering the folded paper sheet to a conveyor having a conveyance path. Then moving the folded sheet along the path toward a cross folder. Next the folded sheet is inserted between infeed rollers of the cross-folder and the folded sheet is pulled forward through the infeed rollers along the conveyance path. Compacting is achieved by pressing the folded sheet between opposing lateral sideplates as said folded sheet is pulled forward by the infeed rollers, the sideplates being located just ahead of said rollers and applying a clamp force to opposing front and rear surfaces of the folded sheet. As will be further described herein, this system provides tightly compacted, fan-folded sheets to the cross-folder.

PREFERRED EMBODIMENT OF THE INVENTION

Figure 1:
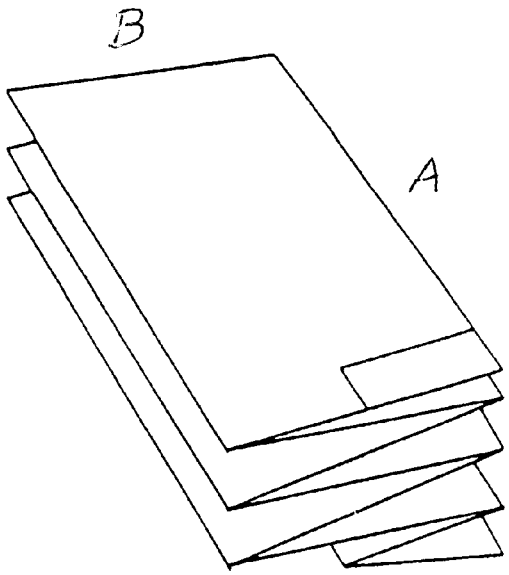
FIG. 1 is a top front side isometric view of a fan-folded document.
Figure 2:
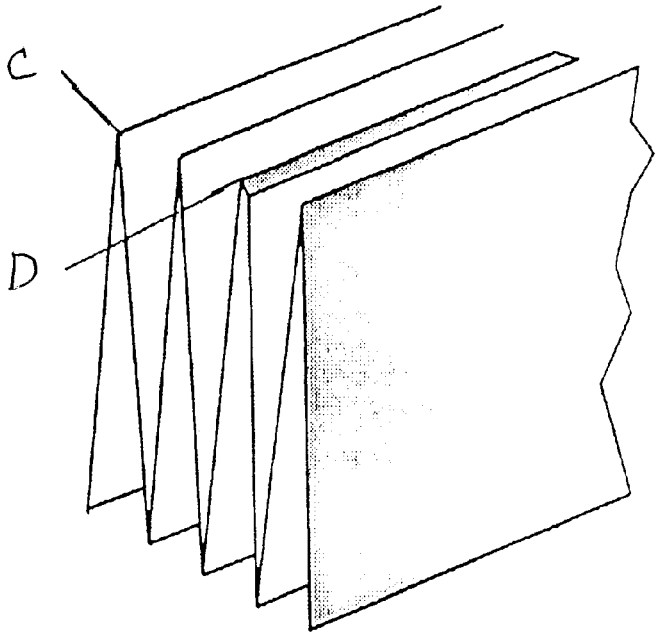
FIG. 2 is a top right side isometric which depicts the prior art double-fold problem.
Figure 3:
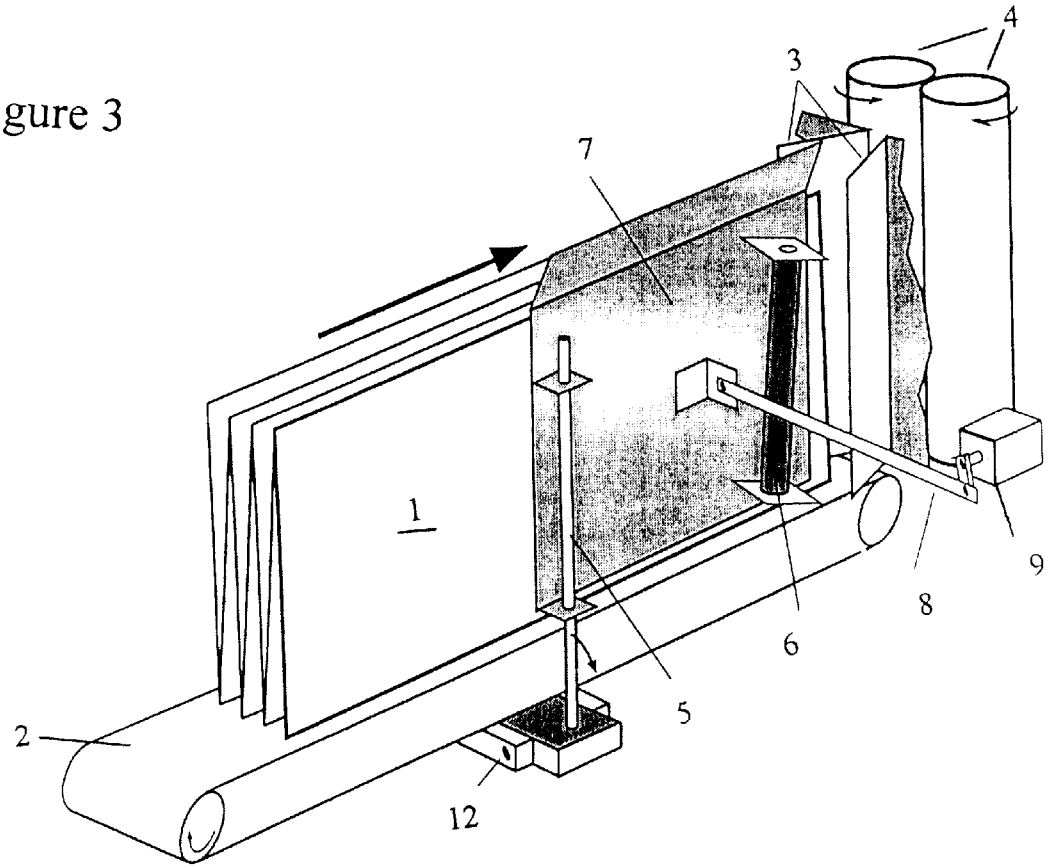
FIG. 3 is a diagramatic top right isometric view of the present invention showing its operation on a fan-folded document.

In the preferred embodiment of the invention described here shown in FIG. 3, the fan-folded document 1 is transported by traction with a conveyor belt 2 to infeed guides 3 and then into the cross-folder infeed rollers 4. An ironing plate 7 swings freely on a hinge pin 5, and is actuated through arm 8 and a crank driven by a stepper motor 9. A gap at the downstream end of the conveyor between ironing plate and backplate 10 is adjusted in small increments by the stepper motor in response to a programmed controller. The fold program provides an operational sequence which is specific to the size and orientation of the print as it enters the folder, and the user's choice of fold packet size, style and orientation.

The folding program provides the following operation. First, the ironing plate gap closes so that as the fan-fold document travels along the conveyer it is arrested between the ironing plate and the backing plate which are in convergent alignment in the forward direction. The point along the path where the fan-folded document stops is a function of the angle and distance between the backing plate and the ironing plate, traction with the conveyer, and the number of panels in the fan-fold. Momentarily halting the movement of the packet against the plate aligns it and ensures that the fan-fold packet enters the cross-folder squarely. The ironing plate position is then backed off in small increments, increasing the gap with the backing plate until the fan-folded document again moves forward through the gap and begins to pass through the infeed rollers.

Figure 4:
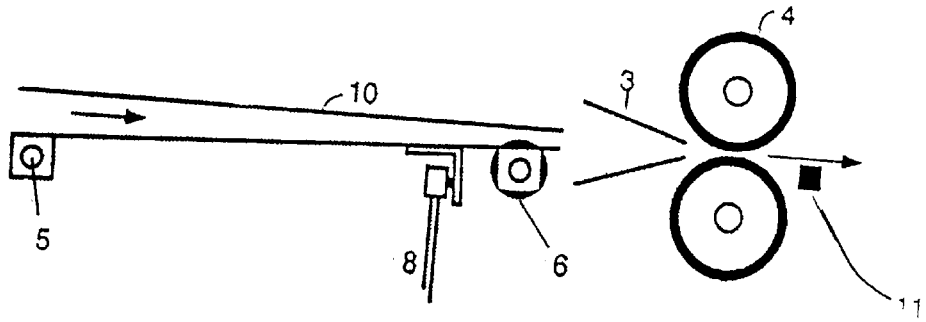
FIG. 4 is a diagrammatic top view of the present invention.

FIG. 4 shows some of the elements of the invention disclosed in FIG. 3, diagrammatically from a top view perspective. Referring now to FIG. 4, the initial passage of the folded document through the infeed rollers is detected by a photosensor 11 located just downstream of the rollers. On the instant of detection by the photosensor, the ironing plate 7 is moved to a more closed position now applying a greater clamp force against the packet which is contacted across the entire surface of the plate. The document then continues forward being pulled into the cross-folder by the rapidly rotating infeed rollers 4 which exert sufficient force to overcome the frictional clamp force of the ironing plate. Thus the folds of substantially the entire document are pressed tightly together prior to entering the infeed rollers. Thereafter, the ironing plate remains tightly clamped until the document is fully within the cross-folder and its trailing edge has passed the sensor, at which point the ironing plate opens to receive the next pocket and the cycle repeats. By this clamping action of the ironing plate, the fan-fold is deflated and compacted, thus helping ensure that false, or double-folding does not occur in the infeed rollers as described above.

An alternate embodiment of the invention includes a bias roller 6, (shown in both FIGS. 3 and 4) affixed to the ironing plate 7 the axis of which is tilted a few degrees from vertical. The bias roller extends through a slot in the ironing plate and exerts a small downward force on the fan-fold document, thus preventing skewing in the cross-folder by ensuring that the document remains in close contact with the conveyor belt.

In yet another embodiment applicable to a system where the fan-folder is located above the conveyor belt, vertical hinge pin 5 is mounted on a block which pivots outwardly on horizontal hinge pin 12. This allows the ironing plate to open along the axis of the conveyor belt, thus presenting a wider opening at the top of the plate to accept the fold packet falling from the fan-folder above.

In light of the foregoing, it will be readily understood that the objects of the invention to avoid skewed cross-folds and false double folds has been achieved. There may be other changes and modifications which are obvious to those of skill in the art from the foregoing invention as disclosed; however, the invention should not be limited by particular embodiment disclosed, but rather should be defined only by the following claim and its legal equivalents.

What is claimed is:

1. A packet ironing system for fan-folded documents, comprising;

a packet conveyor;

a path along said conveyor bounded laterally by an ironing plate on one side and an opposing backing plate on the other side defining a conveyance gap, said ironing plate being laterally rotatable about a vertical axis hinge;

actuator means for moving said ironing plate about a point of rotation defined by said hinge to alter the conveyance gap between said ironing plate and said backing plate;

infeed rollers for moving said packet along said conveyer path;

sensor means located down-stream of said infeed rollers for detecting the position of said packet along said conveyer path; and control means for receiving signals from said sensor and signaling said actuator means to move said ironing plate against said fan-folded document as the document is moved through said gap by the infeed rollers.

2. The device of claim 1 further described in that said control means includes programming whereby as said fan-folded document travels along the conveyer path, the ironing plate gap is first closed to a point where the document is momentarily halted, and then the ironing plate is opened in small increments until the fan-folded document again moves forward.

3. The device of claim 1 further including a bias roller affixed to said ironing plate, said bias roller extending through a slot in said plate and contacting said packet, said roller having an axis of rotation which is tilted a few degrees from vertical and exerting a downward force on the packet as it moves past said bias roller.

4. The device of claim 1 further described in that said vertical axis hinge is mounted to a block which is rotatable about a horizontal axis hinge whereby rotation about said horizontal axis hinge causes said gap to widen at the top of said ironing plate.

5. A method of compacting a folded paper sheet, comprising:

delivering a folded paper sheet to a conveyor having a conveyance path;

moving said folded sheet along said path toward folding means to apply a cross fold to said folded sheet; and pressing said folded sheet between opposing side plates as said folded sheet is moved, said side plates being located just ahead of said rollers and applying a clamp force to opposite sides of said folded sheet.

6. The method of claim 5 further including the step of momentarily halting the movement of said folded sheet along said conveyance path just before it is forceably clamped by said plates.

7. The method of claim 6 wherein said folded sheet is a fan fold document and said folding means is a cross-folder.

* * * * *